US007566277B2

(12) United States Patent
Dahl

(10) Patent No.: US 7,566,277 B2
(45) Date of Patent: Jul. 28, 2009

(54) GOLF PUTTING PRACTICE DEVICE

(75) Inventor: Tomas Dahl, Göteborg (SE)

(73) Assignee: Esoteric Golf Technology International AB, Gothenburg (SE)

( * ) Notice: Subject to any disclaimer, the term of this patent is extended or adjusted under 35 U.S.C. 154(b) by 0 days.

(21) Appl. No.: 12/067,636

(22) PCT Filed: Sep. 21, 2005

(86) PCT No.: PCT/SE2005/001389

§ 371 (c)(1),
(2), (4) Date: Mar. 20, 2008

(87) PCT Pub. No.: WO2007/035142

PCT Pub. Date: Mar. 29, 2007

(65) Prior Publication Data

US 2008/0227561 A1 Sep. 18, 2008

(51) Int. Cl.
*A63B 69/36* (2006.01)

(52) U.S. Cl. ..... 473/265; 473/261; 473/263

(58) Field of Classification Search ..... 473/219, 473/257, 261–265, 417, 157, 158, 251
See application file for complete search history.

(56) References Cited

U.S. PATENT DOCUMENTS 3,107,920 A * 10/1963 Strunk ..... 473/265
3,113,780 A 12/1963 Livingstone
4,725,063 A 2/1988 Hoyt, Jr.
4,732,390 A 3/1988 McCollum
4,732,990 A * 3/1988 Login et al. ..... 548/550
4,913,440 A 4/1990 Ellington
6,019,685 A 2/2000 Fonseca et al.
6,769,995 B1 * 8/2004 Rhodes et al. ..... 473/265

FOREIGN PATENT DOCUMENTS

GB 2271722 4/1994
WO WO 88/09689 12/1988

OTHER PUBLICATIONS

PCT Application No. PCT/SE2005/001389, International Search Report mailed Apr. 13, 2006, 4 pgs.
PCT Application No. PCT/SE2005/001389, Written Opinion mailed Apr. 13, 2006, 6 pgs.

* cited by examiner

*Primary Examiner*—Nini Legesse
(74) *Attorney, Agent, or Firm*—Schwegman, Lundberg & Woessner, P.A.

(57) ABSTRACT

The invention concerns a golf putting practice device including a base plate and a plurality of pins intended to be detachably attached in an upright position in at least two rows on an upper side of the base plate to form a path for a head of a golf putter. The device includes a tilting and restoring unit that allows the pins to bend from their normal upright position when subjected to an impact force and that returns the pins to their normal upright position.

16 Claims, 2 Drawing Sheets

GOLF PUTTING PRACTICE DEVICE

TECHNICAL FIELD

The invention relates to a golf putting practice device comprising a base plate and a plurality of pins intended to be detachably attached in an upright position in at least two rows on an upper side of the base plate as to form a path for a head of a golf putter.

BACKGROUND ART

The putter stroke can be regarded as the most important stroke for a golfer since putting represents about one-half the score of a golfer during a golf game. A number of devices for practicing and improving putting technique has been presented in the past.

U.S. Pat. No. 4,725,063 discloses a device having a number of posts projecting upwardly from an upper surface of a mat as to form two rows intended for guiding a putter head during a stroke. A tee may be placed in a cavity in the top of each post. GB2271722 and U.S. Pat. No. 6,019,685 disclose devices equipped with two parallel L-shaped rails that define the path of the putter head. U.S. Pat. No. 6,669,574 discloses a similar design that further is provided with a buzzer alert arrangement. U.S. Pat. No. 6,769,995 discloses a device comprising guide walls that principally have the same function as the L-shaped rails. WO88/09689 discloses a rather complicated device using electromagnetic sensors and audio generators for detection of putter head deviation from straight path of travel.

A common feature of conventional putting practice devices is that they firmly guide, or interrupt, the movement of a putter head that deviates from the intended path. An effect of this is that the putter head is efficiently guided into the correct path. Another effect is that a user of the device becomes notified in a very clear way if an incorrect putting stroke has been conducted.

However, this has also the effect that the device controls the user which makes it difficult for the user to carry out the putting stroke in a relaxed and natural manner.

Another common feature of conventional putting practice devices is that they are designed for a straight path of the putter head. However, a more thorough analysis of the putting stroke yields that the path of a putter head during a putting stroke is not straight but a more or less elliptic curve. Conventional putting practice devices appear not to take this into account.

DISCLOSURE OF INVENTION

The object of this invention is to provide a golf putting practice device that is simple and reliable in its construction and that has an improved function compared to conventional golf putting practice device. This object is achieved by the technical features contained in claim 1. The dependent claims contain advantageous embodiments, further developments and variants of the invention.

The invention concerns a golf putting practice device comprising a base plate and a plurality of pins intended to be detachably attached in an upright position in at least two rows on an upper side of the base plate as to form a path for a head of a golf putter. The invention is characterized in that that the device comprises a tilting and restoring means that allows the pins to bend from its normal upright position when subjected to an impact force and that returns the pins to their normal upright position. Thus, the device is arranged to allow the pins to be tiltably attached to the base plate such that if a pin is hit by a putter head it bends to its tilted position without affecting the path of the putter head. After the hit, the pin automatically moves back to the upright position. An indication on that a putter head deviates from the intended path will be given by a clicking sound when the putter head hits a pin. An advantageous effect of the inventive design is that the pins only indicate a deviating path of the putter head; they do not obstruct the motion of the putter head. This is a very important feature since the mere thought of that the putter head might hit an obstacle makes it difficult for a user to carry out the stroke in a proper manner. A further advantage is that the pins are kept in place even if they get hit by the putter head.

In a first advantageous embodiment of the invention the tilting and restoring means comprises a magnet and a member exhibiting magnetic properties. Preferably, the magnet is associated with the base plate and the magnetic member is associated with the pins. This way it is possible to achieve a tilting function that works well and that allows for a cost-effective production.

In a second advantageous embodiment of the invention the base plate is provided with a number of openings each of which being adapted to receive a pin, wherein said openings are distributed as to form said rows. Preferably, the openings are arranged at the surface of the base plate. This way there is no need for any parts that project upwardly from the base plate, except for the pins. Hence, the golf putting practice device can be made free from parts that can interfere with the movement of the putter head.

In a third advantageous embodiment of the invention the openings are also distributed in a direction substantially perpendicular to the rows as to allow a variation of a width and/or a curvature of said path. An advantageous effect of this feature is that the device can be adapted not only to different sizes of putter heads but also to suit an individual putting stroke of a particular golfer. As the putting stroke differs from golfer to golfer also the curvature of the putter head path differs between different golfers. The path may be more or less elliptic and may also be more or less symmetric around the position where the putter head hits the ball.

In a fourth advantageous embodiment of the invention the magnet is placed below the opening.

BRIEF DESCRIPTION OF DRAWINGS

In the description of the invention given below reference is made to the following figure(s), in which.

EMBODIMENT(S) OF THE INVENTION

Figure 1:
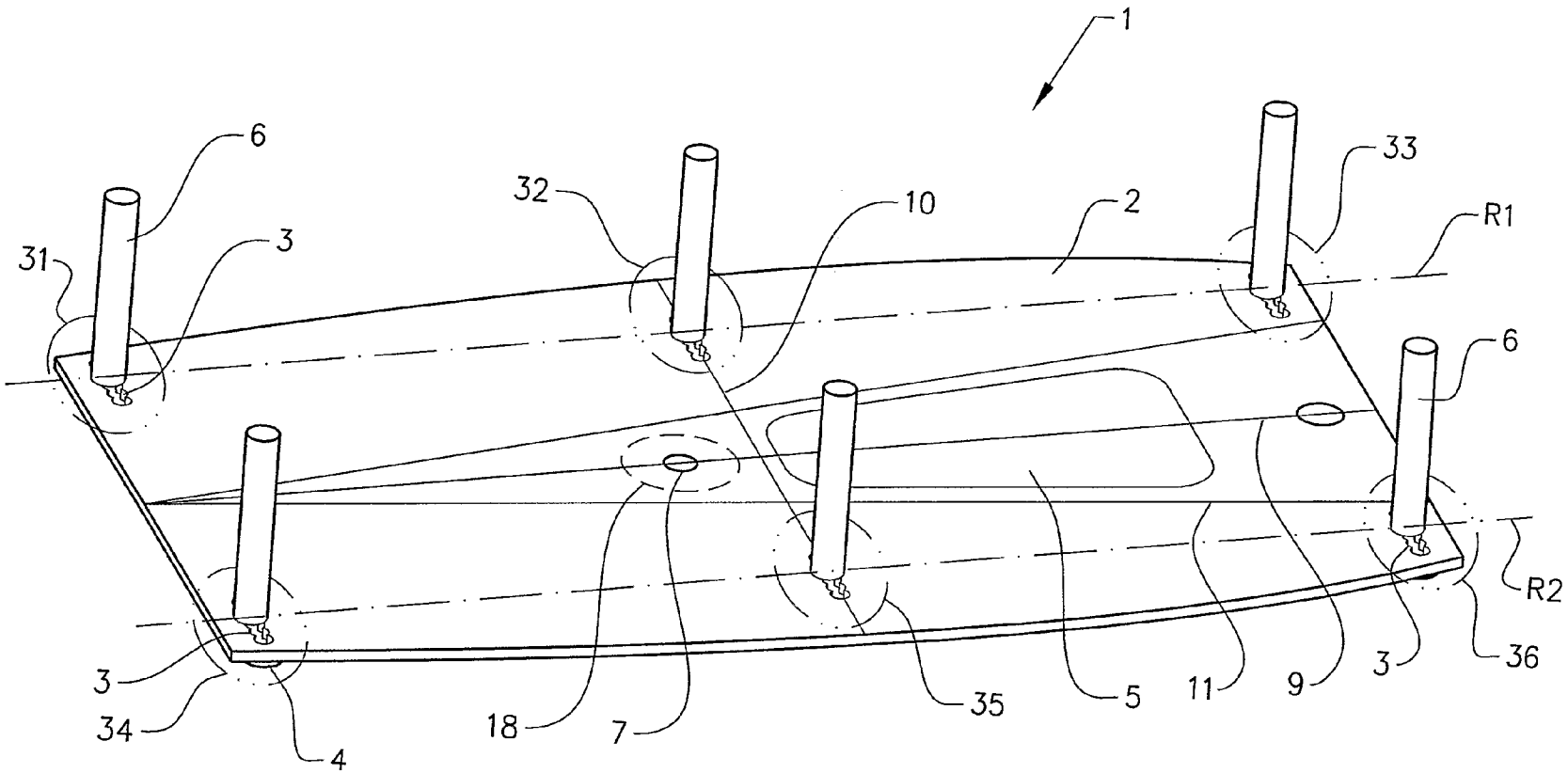
FIG. 1 shows, in a perspective view, a first advantageous embodiment of the invention.

FIG. 1 shows a golf putting practice device 1 comprising a base plate 2 provided with a recess 7 for placement of a golf ball (indicated by the dashed line 18), six pins 6 and a number of openings 3 each of which is adapted to receive a pin 6. A permanent magnet 4 is attached to the base plate 2 below each opening 3. The openings 3 are arranged in six groups 31-36, wherein each group comprises five openings 3 that party overlaps each other. In FIG. 1 the device 1 is positioned such that a putter head is intended to be moved from the right to the left when hitting a ball placed in the recess 7. Since the device 1 is symmetric around a longitudinal center line 9 it allows putting practice from either side of the base plate 2, i.e. the device suits both left- and right-handed golfers. The groups 31-36 of openings 3 are distributed along a longitudinal direction of the base plate 2 in such a way that three groups 31-33 form a first row R1 to the right of a putter path and the remaining three groups 34-36 form a second row R2 to the left of the putter path. Further, the groups 31-36 of openings 3 are arranged as to form a first pair of groups 31, 34 placed at the front of the base plate 2, a second pair of groups 32, 35 placed in the middle and a third pair of groups 33, 36 placed at the rear of the base plate 2. The openings 3 within each group are distributed in a direction substantially perpendicular to the direction of the rows R1, R2. The pins 6 may be placed in either of the openings in each group 31-36 allowing the individual pins 6 to be positioned at different distances from the longitudinal center line 9. This way the position of the pins 6 can be adjusted to various user-specific putter paths. The base plate 2 is further provided with a mirror 5, a lateral center line 10 and an arrow 11 for aiding a user to take the proper position, align and address the ball properly before putting. The mirror 5 is positioned symmetrically around the longitudinal center line 9 and close to the recess 7 as to allow a user to see his eyes when positioned properly. The base plate 2 is preferably made out of a plastic material but other material are also suitable.

Figure 3:
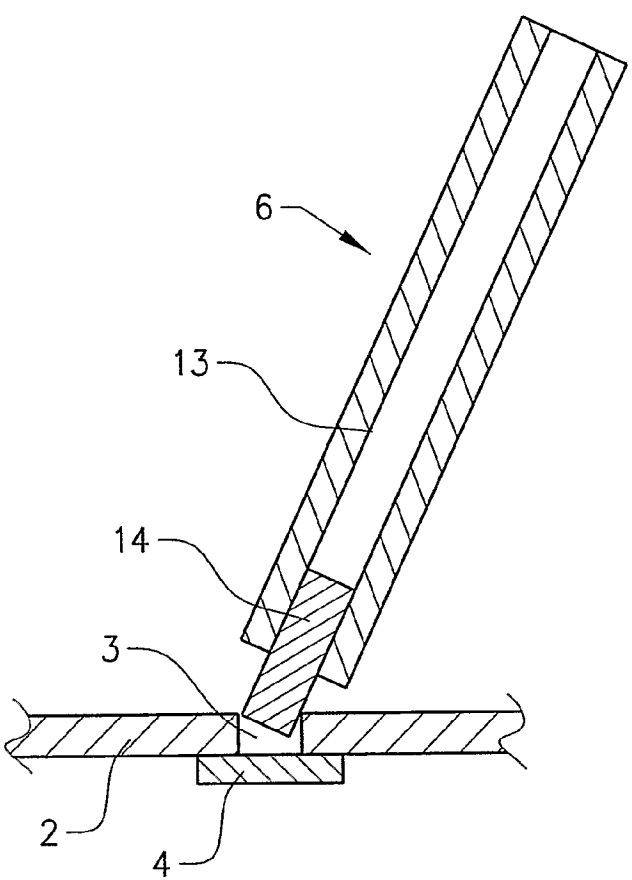
FIG. 3 shows, in a sectional and magnified view, a detail of the embodiment according to FIG. 1 wherein the detail is in a second position.
Figure 2:
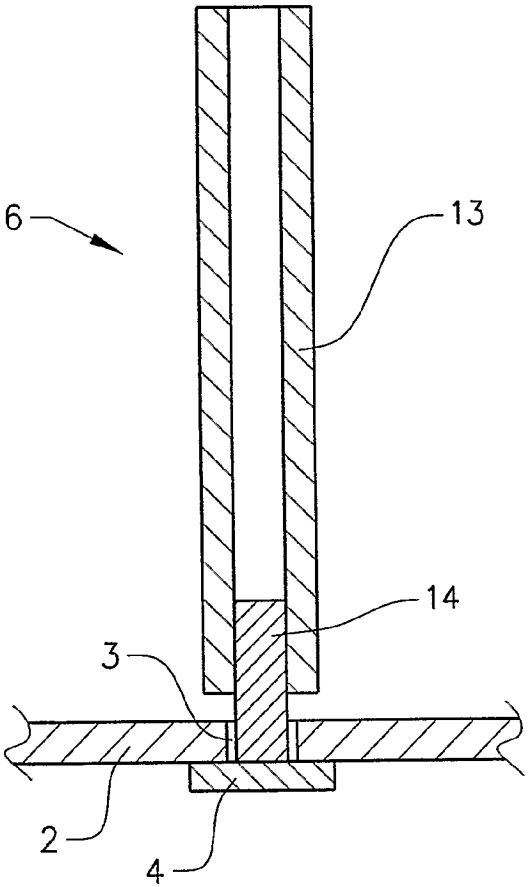
FIG. 2 shows, in a sectional and magnified view, a detail of the embodiment according to FIG. 1 wherein the detail is in a first position.

FIGS. 2 and 3 shows a magnified, sectional view of a pin 6 placed in an opening 3, wherein FIG. 2 shows the pin 6 in a first, upright position and FIG. 3 shows the pin 6 in a second, tilted position. The magnet 4 is placed below the opening 3 on the underside of the base plate 2. The pin 6 comprises an upper part in the form of a cylinder 13 and a lower part in the form of a steel stop screw 14 that is screwed into the cylinder 13. The steel screw 14 exhibit magnetic properties such that an attractive force is created between the magnet 4 and the lower part of the pin 6. The upper part of the pin 6, i.e. the cylinder 13, does not exhibit magnetic properties resulting in that only the lower part of the pin is attracted to the magnet 4. This allows for a reliable tilting and restoring function of the pin 6. In particular, this makes the restoring function reliable when combined with the opening 3 that allows a lever function to form when the pin 6 leans against an upper edge of the opening 3 as shown in FIG. 3. The cylinder is preferably made of a low-weight non-magnetic material such as aluminum, plastics or a composite material. In this context it may be noted that stainless steel normally does not exhibit magnetic properties. A slightly larger diameter of the opening 3 allows the pin 6 to be tilted from its upright position (see FIG. 2) to its tilted position (see FIG. 3). The attractive force between the magnet 4 and the screw 14 restores the position of the pin 6 to its upright position and also maintains the pin 6 in its upright position. The pin 6 is easily forced to its tilted position such that if a pin 6 is hit by a putter head it bends to its tilted position without affecting the path of the putter head. After the hit, the pin 6 automatically moves back to the upright position.

In a preferred embodiment of the invention the cylinder 13 has a height/length of 40 mm and a diameter of 6 mm whereas the screw 14 has a height/length of 10 mm, of which a portion of 6 mm is screwed into the cylinder 13, and a diameter of 4 mm. The opening 3 is preferably a through-hole with a diameter of 5 mm and a depth of 3 mm. To allow for a simple production the thickness of the base plate 2 is preferably 3 mm such that the magnet 4 can be placed on the underside of the base plate 2 and form a bottom of the opening 3.

The use of the golf putting practice device 1 will now be described. In a first step the position of the pins 6 are roughly adjusted to suit the width of the putter head. In a second step the user grips his putter and positions himself such that he can see his eyes in the mirror 5. By performing a few test strokes with the putter the user is able to adjust the positions of the pins 6 as to represent the outer borders of the path of the putter head. To do this one may step by step, i.e. opening 3 by opening 3, move the pins 6 farther away from the longitudinal center line 9 until no pins 6 are hit by the putter head. Alternatively, one may step by step move the pins 6 closer towards the longitudinal center line 9 until the pins 6 are hit by the putter head, and then move them back one step. After this adjustment, one may place a golf ball 18 at the recess 7 and start practicing. An indication on that the putter head deviates from the path the device 1 has been calibrated for will be given by a clicking sound when the putter head hits a pin 6. By doing this exercise now and again a user can identify, and thereby manage to eliminate, any inconsistencies in his putting-stroke.

The invention is not limited by the embodiments described above but can be modified in various ways within the scope of the claims. For instance, the tilting and restoring means 4, 13, 14 could instead of a magnet 4 and a magnetic member 14 include a flexible joint or an articulated pin together with a biasing means, such as a spring, for restoring the pin 6 to its upright position. An advantage of using a magnetic arrangement as described above is, however, that the structure becomes reliable and resistant towards fatigue.

Further, it is not necessary that the magnetic member 14 is screwed into the cylinder 13; it may be attached to the cylinder 13 by using other fastening means such as adhesives or frictional forces. As an alternative structure of the pin 6 one may use a cylinder with a diameter slightly larger than the opening 3, wherein the cylinder has a tapered lower end part that at least partly fits into the opening 3, and wherein the magnetic member 14 is placed in or onto the end part of the cylinder.

It may be noted that the term "row" in this context it is used to describe a side limit of the path of the putter head. Such a limit can be slightly bent, for instance by placing the pin 6 in group 32 in one end position and the pins 6 in groups 31 and 33 in an opposite end position, but the "row" has still a general main direction as indicated in FIG. 1.

The invention claimed is:

1. A golf putting practice device, comprising:

a base plate;

a plurality of pins intended to be detachably attached in an upright position in at least two rows on an upper side of the base plate so as to form a path for a head of a golf putter;

a tilting and restoring unit that allows the pins to bend from a normal upright position when subjected to an impact force and to return the pins to the normal upright position;

wherein the tilting and restoring unit comprises a magnet and a member exhibiting magnetic properties, wherein the magnet is associated with the base plate, wherein the member is associated with the pins, wherein the member forms at least a portion of a lower part of the pins, wherein an upper part of the pins is made of a material that does not exhibit magnetic properties;

wherein the base plate includes a number of openings each of which being adapted to receive a pin, said openings being distributed to form said rows, wherein the openings are arranged at the surface of the base plate; and wherein the magnet is placed below the opening.

2. The golf putting practice device according to claim 1, wherein the magnet is located on an underside of the base plate.

3. The golf putting practice device according to claim 2, wherein the lower part of the pins are made of steel.

4. The golf putting practice device according to claim 3, wherein the openings are distributed in a direction substantially perpendicular to the rows so as to allow a variation in at least one of a width and a curvature of said path.

5. The golf putting practice device according to claim 4, wherein the base plate comprises at least four groups of openings, wherein a first group and a second group forms a first row, and a third group and a fourth group forms a second row, and wherein each group comprises a plurality of openings distributed in a direction substantially perpendicular to the direction of the row.

6. The golf putting practice device according to claim 5, wherein the base plate is provided with a recess for placement of a golf ball, said recess being located approximately halfway between the rows.

7. The golf putting practice device according to claim 6, wherein the base plate includes a mirror positioned in connection to the recess.

8. The golf putting practice device according to claim 2, wherein the base plate is provided with a recess for placement of a golf ball, said recess being located approximately halfway between the rows.

9. The golf putting practice device according to claim 8, wherein the base plate includes a mirror positioned in connection to the recess.

10. The golf putting practice device according to claim 1, wherein the lower part of the pins are made of steel.

11. The golf putting practice device according to claim 1, wherein the openings are distributed in a direction substantially perpendicular to the rows so as to allow a variation in at least one of a width and a curvature of said path.

12. The golf putting practice device according to claim 11, wherein the base plate comprises at least four groups of openings, wherein a first group and a second group forms a first row, and a third group and a fourth group forms a second row, and wherein each group comprises a plurality of openings distributed in a direction substantially perpendicular to the direction of the row.

13. The golf putting practice device according to claim 12, wherein the base plate is provided with a recess for placement of a golf ball, said reccess being located approximately halfway between the rows.

14. The golf putting practice device according to claim 13, wherein the base plate includes a mirror positioned in connection to the recess.

15. The golf putting practice device according to claim 1, wherein the base plate is provided with a recess for placement of a golf ball, said reccess being located approximately halfway between the rows.

16. The golf putting practice device according to claim 15, wherein the base plate includes a mirror positioned in connection to the recess.

* * * * *